US009433851B2

(12) United States Patent
Dahlo

(10) Patent No.: US 9,433,851 B2
(45) Date of Patent: Sep. 6, 2016

(54) DOUBLE-EDGED SKATE BLADE ASSEMBLY AND HOLDER

(75) Inventor: Earl Arthur Dahlo, Coquitlam (CA)

(73) Assignee: Switchblade Sports (BC) Corp., Vancouver, British Columbia (CA)

( * ) Notice: Subject to any disclaimer, the term of this patent is extended or adjusted under 35 U.S.C. 154(b) by 0 days.

(21) Appl. No.: 13/541,601

(22) Filed: Jul. 3, 2012

(65) Prior Publication Data

US 2013/0093150 A1 Apr. 18, 2013

(30) Foreign Application Priority Data

Oct. 18, 2011 (CA) ..... 2754786
Apr. 30, 2012 (CA) ..... 2775510

(51) Int. Cl.
*A63C 1/32* (2006.01)
*A63C 1/30* (2006.01)

(52) U.S. Cl.
CPC *A63C 1/32* (2013.01); *A63C 1/303* (2013.01)

(58) Field of Classification Search
USPC ..... 280/11.12, 11.18, 11.3, 7.13, 841
See application file for complete search history.

(56) References Cited

U.S. PATENT DOCUMENTS 1,094,434 A * 4/1914 Golden ..... 36/115
1,100,976 A * 6/1914 Hille ..... 280/11.18
1,319,094 A * 10/1919 Kerrigan ..... 280/11.12
1,591,778 A 7/1926 Radus
1,646,844 A * 10/1927 Winslow ..... 280/11.12
2,242,870 A 5/1941 Prosey
2,244,719 A * 6/1941 Mansfield ..... 280/11.3
2,988,369 A 6/1961 Rebicek
3,026,118 A * 3/1962 Pare ..... 280/11.3
3,367,669 A * 2/1968 Collins ..... 280/11.3
4,008,901 A * 2/1977 Conn ..... 280/7.13
4,376,604 A * 3/1983 Pratt et al. ..... 411/34
4,492,385 A * 1/1985 Olson ..... 280/7.13
4,645,228 A * 2/1987 Bertonneau ..... 280/603
4,932,675 A * 6/1990 Olson et al. ..... 280/7.13
5,123,664 A 6/1992 DeMars
5,641,169 A 6/1997 Bekessy
5,769,434 A 6/1998 Wurthner
5,791,662 A * 8/1998 Searby et al. ..... 280/7.13
6,164,667 A 12/2000 Olivieri
6,419,241 B1 7/2002 Chenevert
6,481,724 B1 * 11/2002 Whipp ..... 280/7.13
6,485,033 B2 11/2002 Nicoletti et al.
6,523,835 B1 2/2003 Lyden
6,568,710 B2 * 5/2003 Kim ..... 280/809
7,243,924 B2 7/2007 Dahlo et al.
7,673,884 B2 3/2010 Wuerthner
D659,216 S 5/2012 Wuerthner
2008/0290619 A1 11/2008 Leo
2010/0096839 A1 4/2010 Wurthner

* cited by examiner

*Primary Examiner* — Frank Vanaman
(74) *Attorney, Agent, or Firm* — DWC Law Firm, P.S.; David Chen

(57) ABSTRACT

A double-edged skate blade assembly for an ice skate comprising a double-edged blade and a pair of blade supports, each of which is individually replaceable. The assembly includes mechanisms to mate the blade supports about the blade, to connect the blade supports to each other, to interlock the blade and support assembly into a blade holder on the skate and to fasten the blade assembly to the blade holder. The entire blade assembly is easily removable, reversible and replaceable in a skate with little or no requirement for tools. The invention also comprises a holder to securely support the skate blade assembly on the boot of the ice skate.

14 Claims, 13 Drawing Sheets

DOUBLE-EDGED SKATE BLADE ASSEMBLY AND HOLDER

FIELD OF THE INVENTION

This invention relates to a double-edged skate blade assembly that is easily removable and replaceable in an ice skate, as well as the holder to support the skate blade assembly.

BACKGROUND OF THE INVENTION

Ice hockey skates today generally comprise a sharpened metal blade or runner fastened to a holder, which is in turn fastened to a skate boot. Figure skates generally comprise a sharpened metal blade brazed to a holder portion that is then fastened to a skate boot. When the blade of a skate becomes dull, the surface of the blade that contacts the ice surface is re-sharpened to provide a hollow between a set of opposed inner and outer edges. This configuration allows a skater to move and manoeuvre on the ice. Each time the blade is sharpened, metal is physically removed from the blade; each time metal is removed from the blade during a sharpening, the balance and feel of the skate may change, because the separation between the bottom edge of the holder and the ice (which is simply determined by the amount of blade that is still exposed at the bottom of the holder) is different than it was before the blade was sharpened. Over time the skate will eventually run out of blade, necessitating replacement of the blade holder or, more often, the entire skate.

Occasionally a blade will break, for example under the impact of a puck or contact with another object on the blade, which also necessitates replacement of the blade. If the skate boot is in otherwise good condition, a new blade may be provided for the same boot, but because the blade is generally not intended to be separated from its holder, it is necessary to replace the entire holder as well as the blade.

Current methods of skate sharpening also generally require that the skate be removed from a wearer's foot. If a skater notices that a blade has become dull while he or she is on the ice, it is generally necessary to remove the skate, take it to a skate sharpening machine, sharpen the blade, and replace the skate on the skater's foot before returning to the ice. During a hockey game or a figure skating competition, for example, this may be an unacceptable amount of time to be away from the ice. If there is no skate sharpener readily available, the time away from the ice is necessarily increased. The alternative is to skate on dull blades, which adversely affects the skater's mobility and ability to perform necessary manoeuvres.

In some circumstances, a skater may simply wish to use a blade with different characteristics, for example to respond to different ice conditions. It is often easier to manoeuvre on softer ice using a blade with a particular hollow radius, while a deeper hollow would perform best on harder ice. However, the ice conditions may not be known until the skater has put on the skates and taken a few moments to skate around the ice. Occasionally, the ice conditions vary during the course of a game; for example, temperature changes because of the presence of spectators can change the ice temperature and condition over time. In this situation, even if a different pair of skates is available, it is often inconvenient to return to the dressing room to change into that other pair of skates.

It is therefore preferable to be able to replace a dull blade or to simply replace an unsatisfactory blade without having to remove the skate boot from a skater's foot. There exist several examples of removable blade systems, such as U.S. Pat. No. 6,419,241 to Chenevert and U.S. Pat. No. 6,485,033 to Nicoletti et al, which disclose a skate blade that may be removed from a skate by removal of one or more threaded fasteners, and replaced with a new blade that is then secured with those fasteners.

It is noted that such systems require the user to carry one or more replacement blades, and possibly the proper tools to effect a blade change. In such cases, it is necessary either to carry the replacement blade(s) and the tools, if needed, to the ice, or to return to the dressing room to access the necessary blade and equipment. It is therefore also preferable to minimize the number of replacement blades that a skater has to carry at one time, as well as to increase the accessibility of the blades to a skater while he is on the ice. One way to accomplish the former is to provide a single skate blade that is reversible; that is a single blade that has two opposed ice-contacting surfaces, either of which may be used to skate on. Such reversible blades are shown, for example, in U.S. Pat. No. 1,591,778 to Radus and U.S. Pat. No.2,242,870 to Prosey. These two patents disclose similar I-shaped double-edged blades having longitudinal grooves between the ice contacting surfaces of the blades. The longitudinal grooves are the means by which the blades are clasped between opposed arms depending from the blade holder, and fastened thereto.

However, the presence of a substantially thinned area along the central length of the blade may tend to destabilize the blade under the lateral torque forces typically created during the skating stride and when performing other manoeuvres. It is therefore preferable to provide a blade having a substantially uniform thickness between the two ice-contacting surfaces. U.S. Patent Pub. No. 2008/0290619 to Leo discloses a reversible blade having a figure skate configuration on one edge and a hockey skate blade configuration on the opposite edge. U.S. Pat. No. 7,243,924 to Dahlo et al. and U.S. Pat. No. 6,523,835 to Lyden disclose nearly elliptical blades without longitudinal grooves. Fastener openings are provided to secure the blade within the blade holder. Where necessary, the blade may be made lighter, without sacrificing stability, by providing one or more apertures through the blade.

As noted above, a second purpose of using replaceable, reversible skate blades is to minimize the need for tools to actually make the replacement. Each of the previously mentioned patents uses threaded screws or bolts that may be finger-tightened, but would likely preferably require a screwdriver or similar tool to provide sufficient assurance that the blade is securely attached to the blade holder.

Some examples of patents disclosing replaceable skate blades which do not require the use of tools include U.S. Pat. No. 5,123,664 to DeMars and U.S. Pat. No. 5,641,169 to Bekessy. However, the systems disclosed in these patents are relatively complex and contain a number of moving parts embedded within the blade holder. In addition to adding undesirable weight to the skate, these assemblies may be susceptible to damage, for example under a blow to the blade holder from a puck or simply from being dropped on the ground. U.S. Pat. No. 2,988,369 to Rebicek discloses a relatively simple replaceable blade, but given that the blade is secured only at the toe end, this arrangement may not have the same ability to secure the blade as other systems.

Another consideration when changing skates blades is that the holder (generally made of polymeric material) and the blade (generally metallic) will have different thermal expansion properties, such that temperature fluctuations may cause a blade that fits securely to the holder in one orientation to not fit properly or at all after the blade is removed from the holder in preparation for reversal. Using metallic fasteners can also cause problems; even if the fasteners are securely attached to the blade and holder while the skater is off the ice attaching the blade (and the blade and blade holder are warm), the blade may become loose once the skater returns to the ice and the temperature of the entire assembly decreases.

It is therefore an object of the invention to provide double-edged blade assembly for a skate that overcomes the foregoing deficiencies.

It is a further object of the invention to provide a holder for a double-edged skate blade skate blade assembly that is strong, secure and supportive.

It is a further object of the invention to provide a holder for a double-edged skate blade skate blade assembly that allows the skate blade to be quickly and easily removed, reversed and/or replaced.

It is yet a further object of the invention to provide a double-edged skate blade assembly having replaceable supports on either side of a skate blade to allow fast and secure removal and installation of the blade without having to remove the skate from the foot.

These and other objects of the invention will be appreciated by reference to the summary of the invention and to the detailed description of the preferred embodiment that follow. It will be noted that not all objects of the invention are necessarily realized in all possible embodiments of the invention as defined by each claim.

SUMMARY OF THE INVENTION

The invention relates to a double-edged skate blade assembly including a blade and one or more support pieces to secure the blade assembly within a blade holder, as well as a blade holder to mate with the assembly.

In one aspect, the invention comprises a blade assembly for an ice skate, including an elongated skate blade having a pair of opposed ice-contacting edges, and a plurality of apertures through the blade between the opposed ice-contacting surfaces; and a plurality of elongated blade supports, each having an inner surface bearing at least one alignment means adapted to align with at least one of the apertures and to removably mate the blade supports with the blade. The blade may have one or more inset sections to accommodate the blade supports. The alignment means may comprise one or more projections on the inner surface, each of the projections being adapted to mate with one of the apertures. In a further aspect, the alignment means may comprise connecting means to connect the blade supports to each other, which may be studs on one of the blade supports and corresponding cavities on another of the blade supports.

In a further aspect, the blade assembly may comprise means to removably interlock the skate blade to a blade holder of the skate. Such means may comprise teeth on at least one of the blade supports to correspond to teeth on the blade holder.

In yet a further aspect, the blade assembly may comprise a locking means to fasten the blade assembly to a blade holder of the skate. The locking means may comprise at least one fastener adapted to pass through a set of coaxial passageways in the blade, the blade supports and the holder, and may further include at least one expandable sleeve insertable in the passageways to accommodate the fastener.

In yet a further aspect, at least one of the blade supports may further comprise at least one impact distribution surface on an outer surface of the blade support. The impact distribution surface may comprise a ridge parallel to a longitudinal centreline of the blade support.

In another aspect, the invention comprises a blade support for a double-edged skate blade, comprising an inner surface bearing at least one alignment means adapted to align with at least one aperture on the blade; and connecting means on the inner surface to connect the blade support to an other blade support about the blade. The alignment means may comprise one or more projections on the inner surface, each of the projections being adapted to mate with one of the apertures. The connecting means may comprise one or more studs adapted to connect to corresponding cavities on the other blade support.

In a further aspect, the blade support may comprise means to removably interlock the blade support to a blade holder of an ice skate. These means may comprise teeth on an outer surface of the blade support to correspond to teeth on the blade holder.

In yet a further aspect, the blade support may comprise at least one passageway to accommodate locking means to fasten the blade support to a blade holder of a skate.

In yet a further aspect, the blade support may comprise at least one impact distribution surface on an outer surface of the blade support. The impact distribution surface may comprise a ridge parallel to a longitudinal centreline of the blade support.

In yet another aspect, the invention comprises a skate blade holder for a double-edged skate blade assembly for an ice skate, comprising an upper platform to be attached to the ice skate; opposed sidewalls depending from the upper platform and terminating in a lower edge; a groove between the opposed sidewalls at the lower edge to accommodate the removable double edged skate blade assembly; and at least one interlocking means within the groove adapted to interlock with a corresponding interlocking means on the blade assembly. The interlocking means may comprise at least one set of teeth corresponding to a set of teeth on the blade assembly. The holder may further comprise a locking means to fasten the blade assembly to the blade holder; the locking means may comprise at least one fastener adapted to pass through a set of coaxial passageways in the blade assembly and the holder, and may further comprise at least one expandable sleeve insertable in the passageways to accommodate the fastener.

In yet another aspect, the invention comprises an ice skate with a double-edged skate blade assembly, comprising an elongated skate blade having a pair of opposed ice-contacting edges, and a plurality of apertures through the blade between the opposed ice-contacting surfaces; a plurality of elongated blade supports, each having an inner surface bearing at least one alignment means adapted to align with at least one of the apertures and to removably mate the blade supports with the blade; and a holder to removably secure the blade and blade supports to the ice skate. The holder may further comprise an upper platform to be attached to the ice skate; opposed sidewalls depending from the upper platform and terminating in a lower edge; a groove between the opposed sidewalls at the lower edge to accommodate the double edged skate blade assembly; and at least one interlocking means within the groove adapted to interlock with a corresponding interlocking means on the blade assembly.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The preferred embodiment of the invention will be described by reference to the drawings in which.

DETAILED DESCRIPTION OF THE INVENTION

Figure 1:
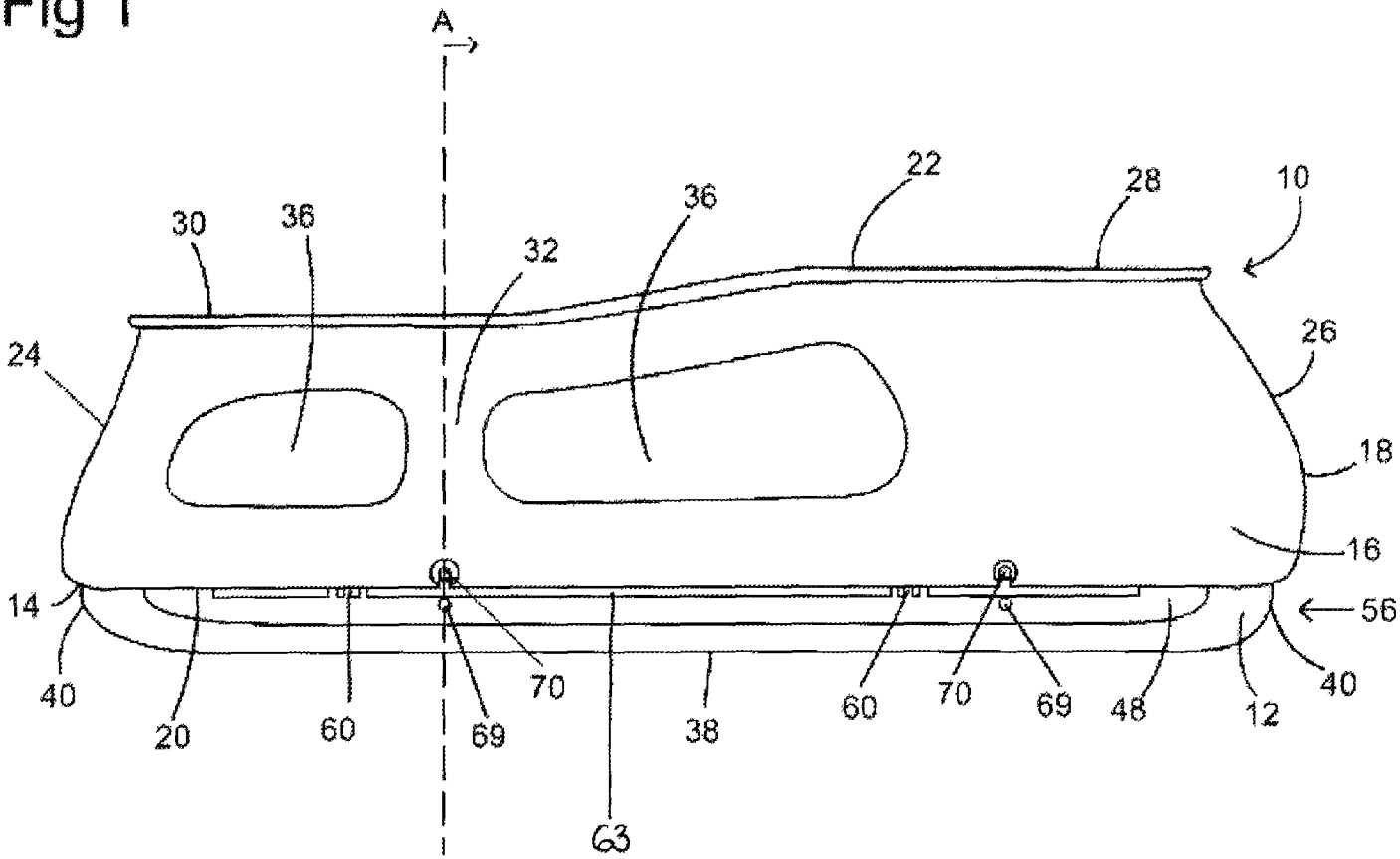
FIG. 1 is a side view of the double-edged skate blade assembly and holder.

Referring to FIGS. 1-6, a blade holder 10, intended to be attached to the boot (not shown) of an ice skate, accommodates a skate blade or runner 12 within a groove 14 formed between opposed sidewalls 16, 18 at the lower edge 20 of the blade holder 10 ("lower" being understood to mean the portion of the holder 10 that is closest to the ice when the skate is in use, and/or that is remote from where the boot of an ice skate would be when the holder 10 is in place on the skate, and "upper" being understood to mean the portion of the holder 10 that is proximate where the boot would be). The lower edge 20 of the blade holder 10 is preferably substantially flat along the length of the lower edge 20. The upper platform 22 of the blade holder 10 preferably underlies substantially the entire sole of the boot of the ice skate, providing torsional rigidity to the skate and to the blade holder 10. The front or toe end 24 of the holder 10 is preferably slightly curved between the lower edge 20 and the platform 22, while the back or heel end 26 of the holder 10 is also preferably slightly curved between the lower edge 20 and the platform 22.

The upper platform 22 may be substantially flat, or may be hollow at one or both of the heel 28 and toe 30 portions, in order to decrease the overall weight of the blade holder 10. A support post 32 under the hollow toe portion 30 assists in providing strength, integrity, and torsional rigidity to the holder 10. One or more lateral ribs 34 may be included across the upper platform 22 to further stabilize the blade holder 10.

In order to reduce the weight of the blade holder 10, one or more apertures 36 may be formed within the holder 10 at any place(s) between lower edge 20 and upper platform 22. Alternatively or in addition, blade holder 10 may be substantially hollow between sidewalls 16, 18 to further decrease the overall weight of the blade holder 10.

Referring now to FIGS. 7*a*-7*f*, the blade 12 comprises a flat elongated piece, having opposed flat sides edged by a pair of opposed long edges 38, one of which is to be in contact with the ice when the skate is in use, while the other is contained within holder 12 (not shown). Opposed long edges 38 are separated by opposed curved ends 40, which may or may not have identical curvatures to each other, forming an elongated elliptical shape with one or two axes of symmetry. All or part of the blade 12 may be coated with a material, such as TEFLON® or a ceramic, that improves desirable characteristics of the blade, such as its ability to glide smoothly along ice or to hold a sharp edge.

Figure 7A:
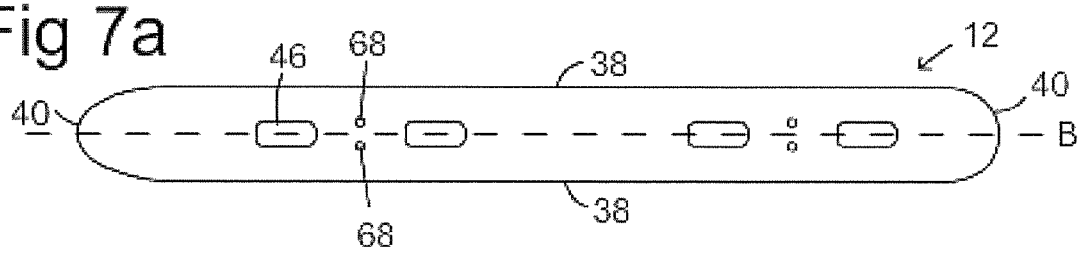
FIGS. 7*a* and 7*b* are side views of two embodiments of the double-edged skate blade.
Figure 7B:
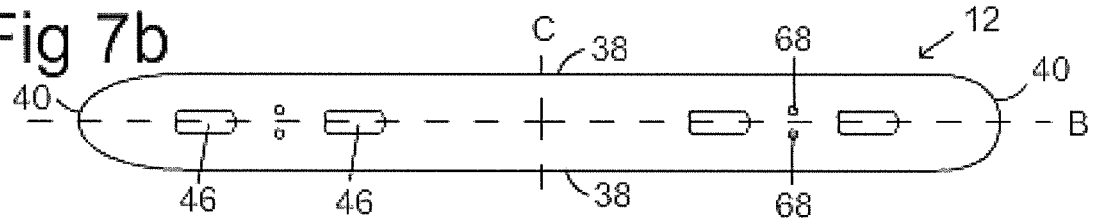

As best shown in FIGS. 7*a* and 7*b*, the blade 12 may comprise one or more apertures 46 through blade 12, to decrease the overall weight of the blade 12. The apertures 46 may be of any suitable number, size, shape and distribution along the blade. Apertures 46 are preferably symmetrical about the longitudinal centreline B of blade 12, in order to assist in maintaining the balance of the blade 12. The apertures may also be symmetrical about the centerline C of the blade 12, as shown in FIG. 7*b*, but are preferably somewhat asymmetrical, as in FIG. 7*a*, in order to make it easier for the user to quickly determine which end 40 matches to the front and rear of the blade holder.

Figure 7C:
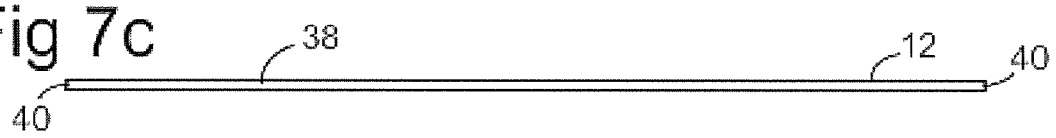
FIGS. 7*c* and 7*d* are bottom views of two embodiments of the double-edged skate blade.

In another aspect, blade 12 may be a substantially uniform thickness throughout its length, as shown in FIG. 7*c*. In this configuration, it is possible to place the blade 12 within the holder 10 in any one of four different configurations, as either of curved ends 40 may be at the toe end 24 (not shown) of the holder 10, and either of long edges 38 may be exposed, as long as the blade 12 fits properly into the holder 10 (not shown). This can simplify installment of the blade 12 into the holder 10, because it is not necessary to be concerned about which curved end 40 is at which end of the holder 10 (not shown).

Figure 7D:
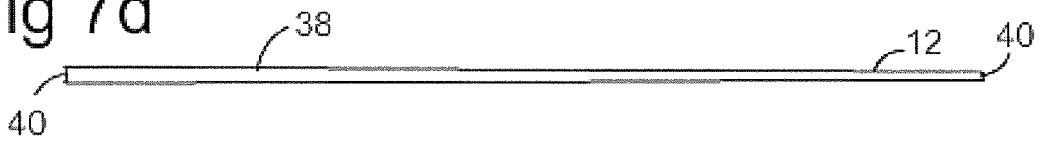

In another embodiment, shown in FIG. 7*d*, the thickness of the blade 12 may taper along its length, such that each long edge 38 is slightly thicker at one curved end 40 than at the opposite curved end 40. This may improve the gliding characteristics of the blade. However, it is necessary when reversing the blade 12 within holder 10 to ensure that the thick end is always placed at the toe end 24 of the holder 10; one way to do so would be to ensure that the apertures 46 are asymmetrical, as in FIG. 7*a*, such that the blade 12 only fits into holder 10 in the two correct positions.

Referring again to FIGS. 1-6, the configuration of the blade holder 10 is such that one long edge 38 of skate blade 12 is exposed when blade 12 is inserted into the holder 10, and will come in contact with the ice surface when the skate is in use. The opposed long edge 38 is enclosed within the holder. The front end 24 and back end 26 of the blade holder 10 preferably extend sufficiently over the curved ends 40 to protect the skater, other skaters and/or surrounding objects.

Figure 8A:
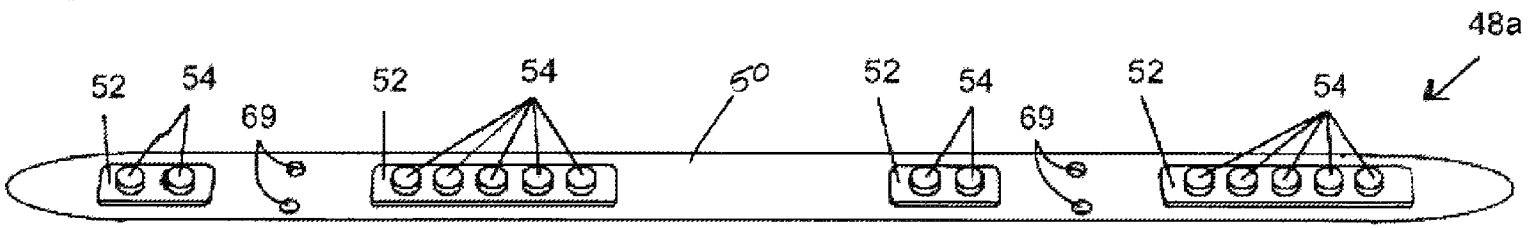
FIGS. 8*a* and 8*b* are views of the inside surfaces of blade supports for the double-edged skate blade assembly.
Figure 8B:
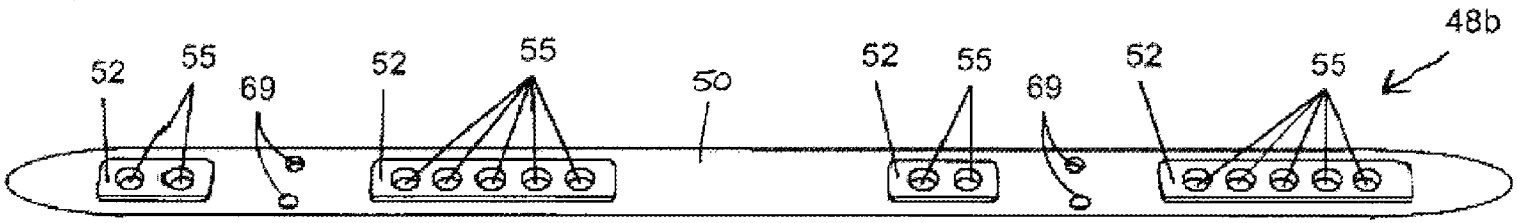

Opposed blade supports 48 are provided on either side of the blade 12 to provide additional strength and stability through at least a portion of the length of the blade 12. One blade support 48*a*, which is shown in FIG. 8*a*, comprises an inner surface 50 containing alignment means to mate it with the side of blade 12, such as one or more projections 52, which align with apertures 46. A second blade support 48*b*, which will mate with the opposite side of blade 12, is shown in FIG. 8*b*. An alignment means such as one or more projections 52 may also be provided on the inner surface 50 of the second blade support 48*b*, to assist in aligning the blade support with corresponding apertures 46 in blade 12, but it will be understood that any suitable alignment means may be used to correctly align the blade support 48*b* with blade support 48*a* transversely through blade 12. For example, it is also possible to mate the pieces in the opposite manner, i.e. by providing projections on blade 12 that correspond to apertures on one or both of blade supports 48.

In order to ensure that the blade supports 48*a* and 48*b* hold securely about the blade 12, connecting means may be provided to allow the opposed blade supports to connect with each other. For example, projections 52 on blade support 48*a* may be provided with studs 54, which mate with cavities 55 on opposed blade support 48*b* in a manner similar to a toy building block. It will be appreciated that other connecting mechanisms may be used, as well as different embodiments of this connecting mechanism, such as more or fewer numbers of matching studs 54 and cavities 55, or differently shaped studs 54 and/or cavities 55.

Figure 7E:
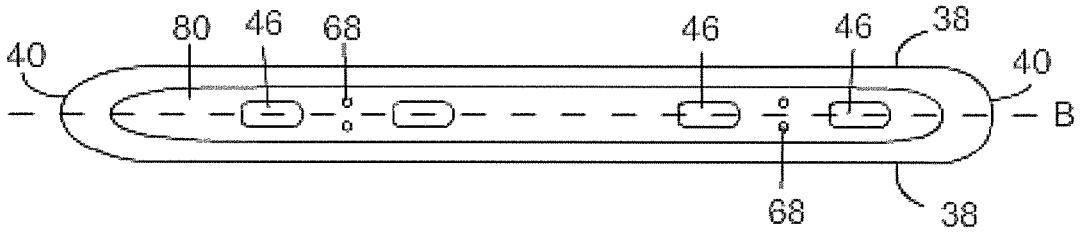
FIGS. 7*e* and 7*f* are side and end views of another embodiment of the double-edged skate blade.
Figure 7F:
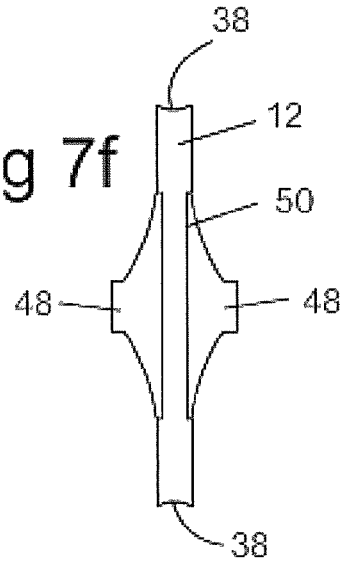

In another embodiment, best shown in FIGS. 7*e* and 7*f*, blade 12 may be provided with a slightly inset section 80 on either or both sides of the blade 12. This allows for a more exact alignment between the blade 12 and the blade supports 48. The addition of blade supports 48 also allows the use of such a blade having a thinner, lighter inset section 80 without sacrificing substantial strength or torsional rigidity of the blade assembly.

Blade supports 48 may also provide additional strength against lateral forces. In case of a very strong lateral force, such as a puck striking the side of the blade 12, particularly near the centre of the blade, the force may be sufficient to deform the blade 12, rendering it unusable. However, with the addition of opposed blade supports 48, the blade supports themselves will crack and break first, dissipating the lateral forces before they can irreversibly damage the blade. This can increase the lifetime of a blade 12.

Figure 2A:
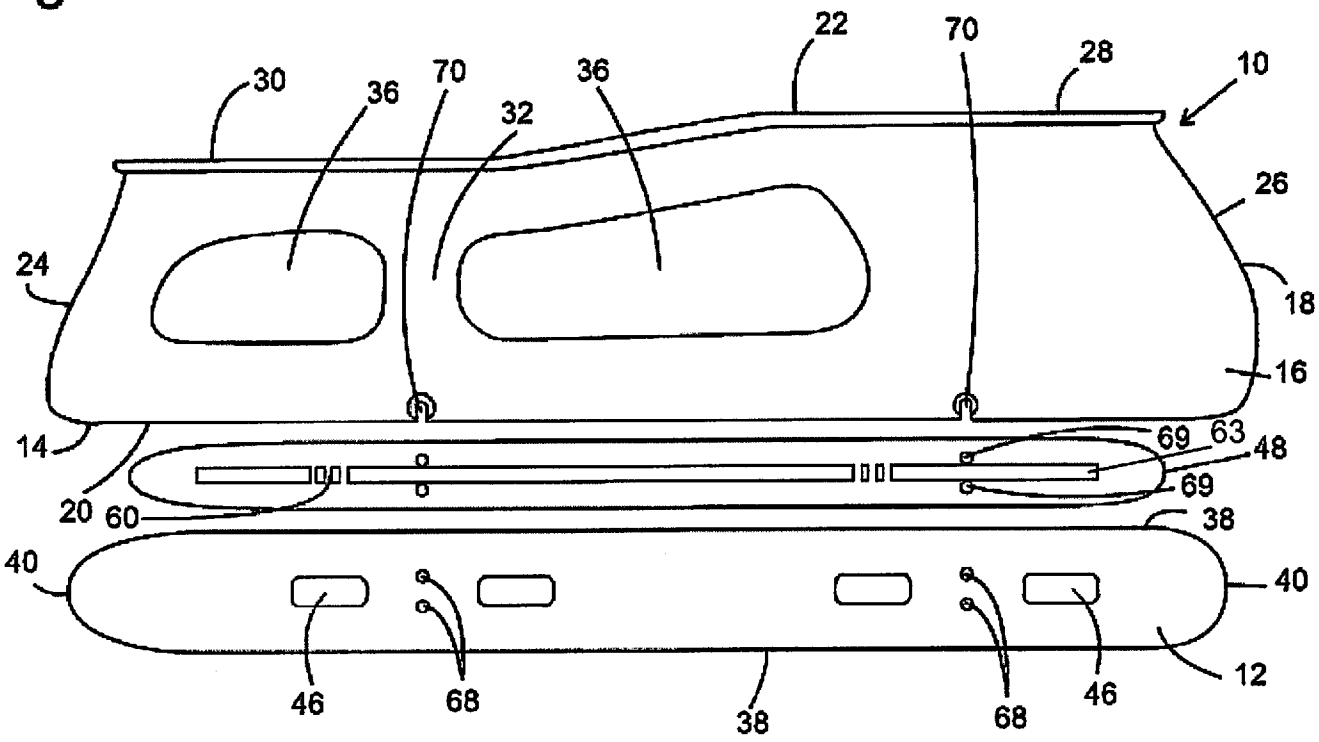
FIG. 2*a* is an exploded side view of the double-edged skate blade assembly and holder.
Figure 2B:
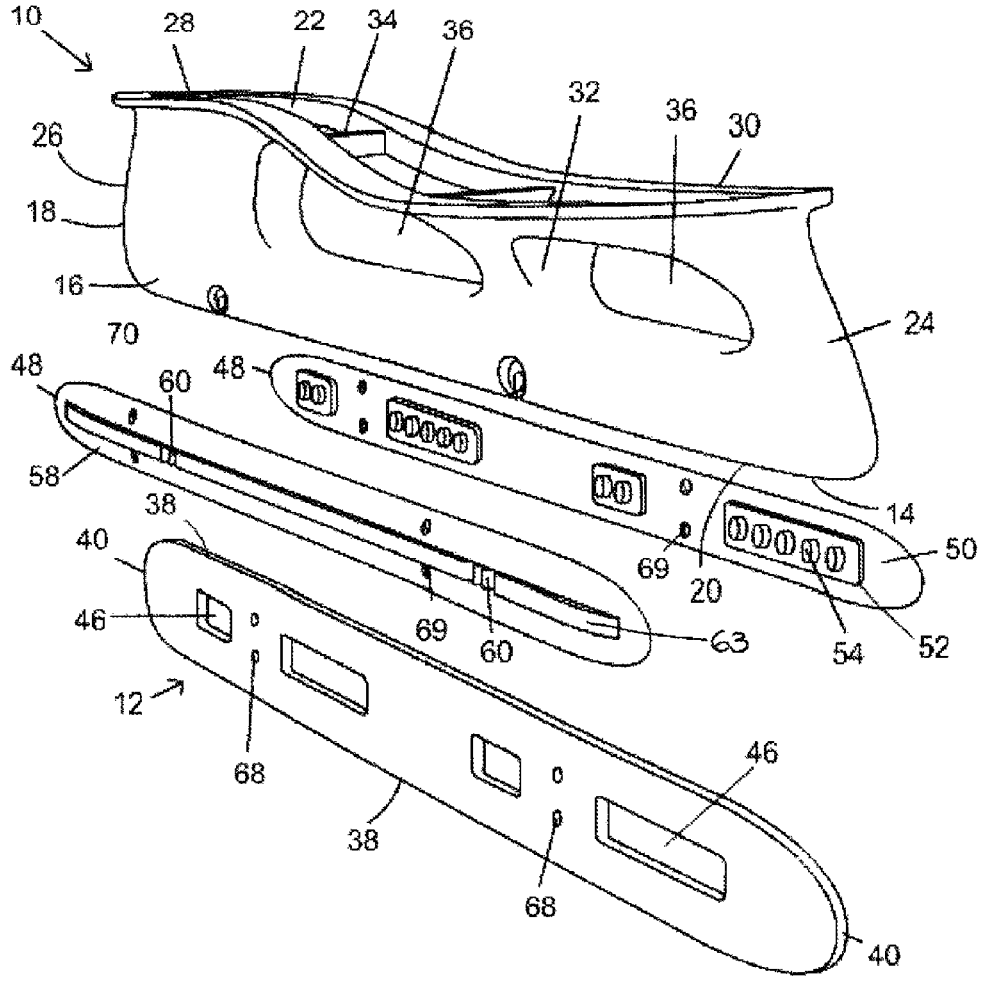
FIG. 2*b* is an exploded perspective view of the double-edged skate blade assembly and holder.
Figure 3:
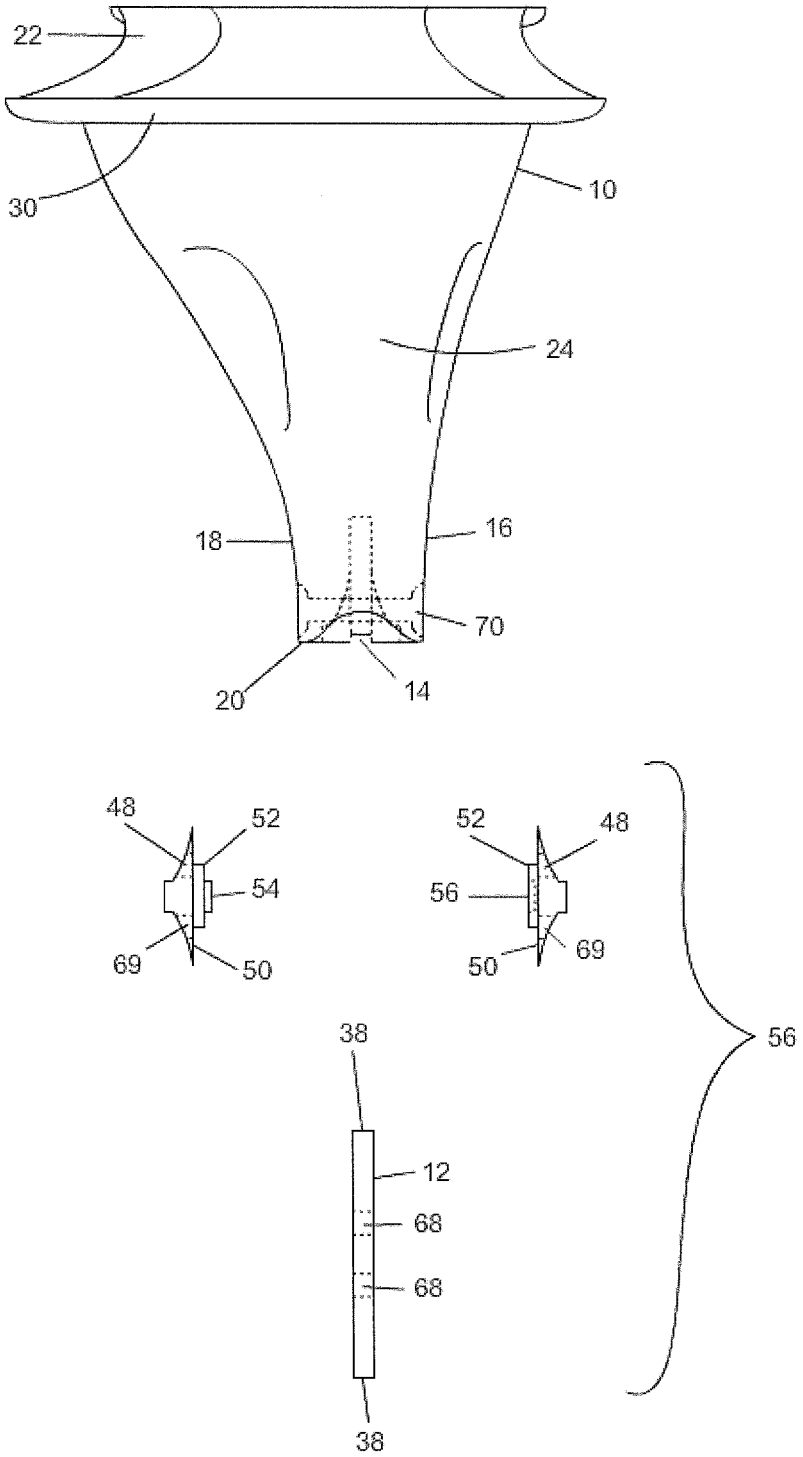
FIG. 3 is an exploded view of the front end of the double-edged skate blade assembly and holder.
Figure 4:
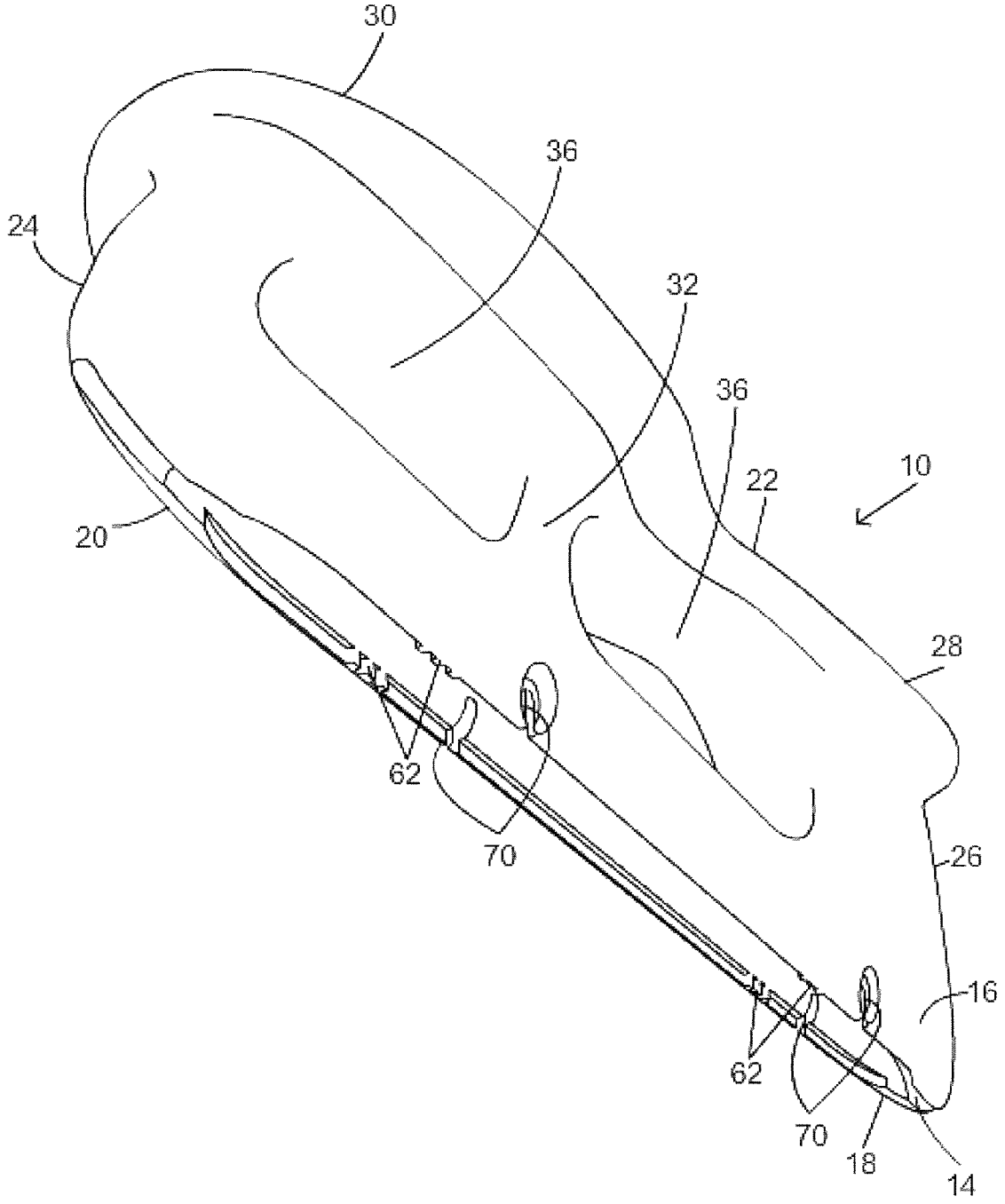
FIG. 4 is a perspective view of the underside of the holder.
Figure 5:
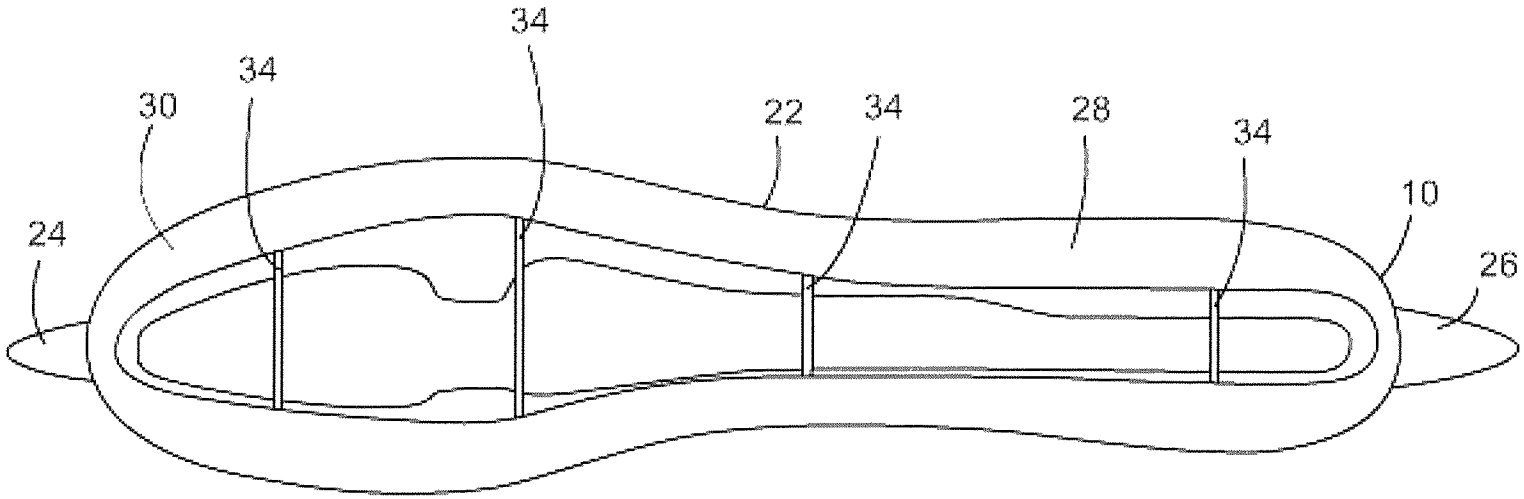
FIG. 5 is a top view of the holder.
Figure 6:
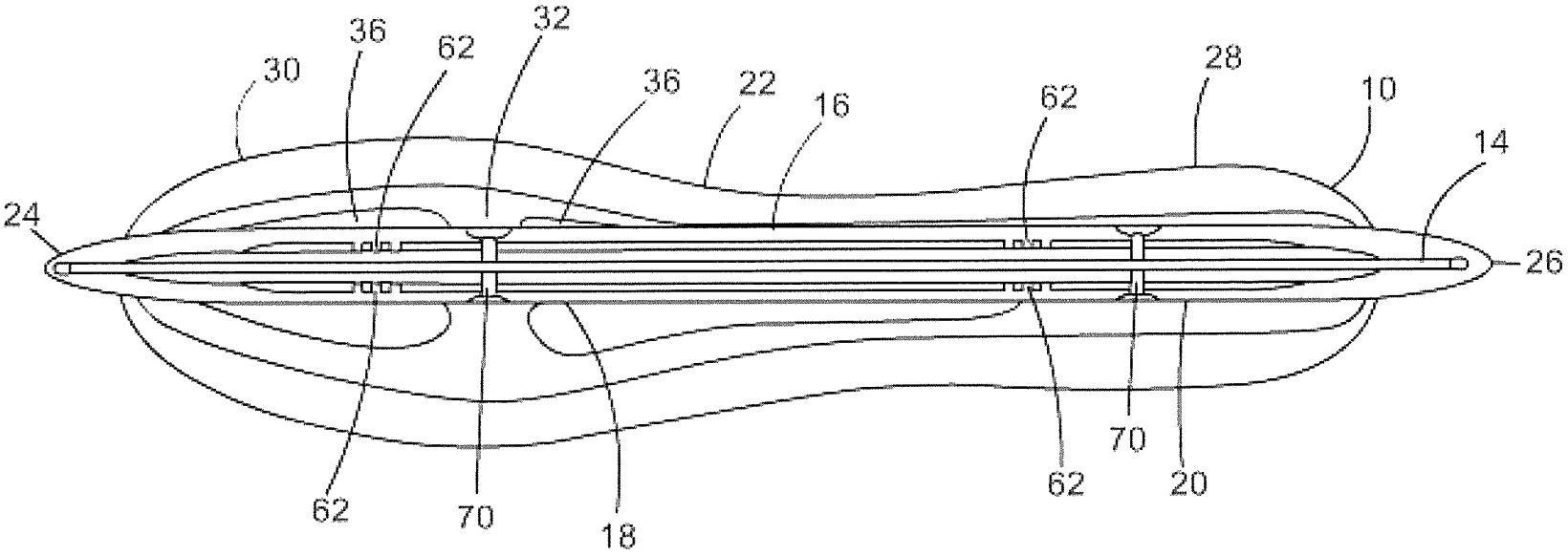
FIG. 6 is a bottom view of the holder.

Blade supports 48 may also serve as a means to physically join the blade 12 with the blade holder 10, by providing the outer surface 58 of one or more of the blade supports 48 with suitable means to interlock the blade assembly 56 and the holder 10. One example of such interlocking means is best shown in FIGS. 2*a* and 2*b*, in the form of a set of teeth 60 provided at one or more locations along the blade support 48. As shown in FIGS. 4 and 6, each of sidewalls 16, 18 of groove 14 are provided with one or more sets of matching teeth 62 that will mesh with the blade support teeth 60. When the blade assembly 56, comprising the blade 12 sandwiched by a pair of blade supports 48, is inserted into holder 10 such that holder teeth 62 mesh with support teeth 60 at one or more locations, the assembly 56 is securely held with the holder 10, preventing it from falling out unless enough force is applied to pull the blade assembly 56 out of its engagement with holder 10. Further, the meshing of the two sets of teeth 60, 62 prevents the blade assembly 56 from moving longitudinally within the holder 10.

Figure 9B:
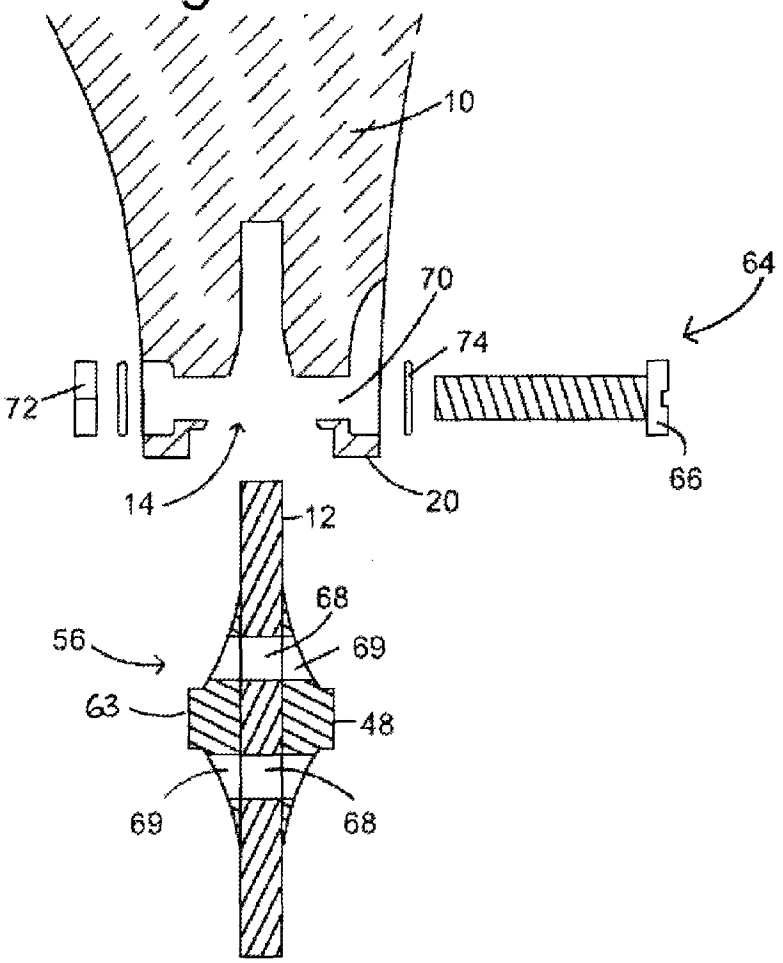
FIGS. 9*a* and 9*b* are sectional views of a first locking mechanism, taken along line A-A of FIG. 1.
Figure 9A:
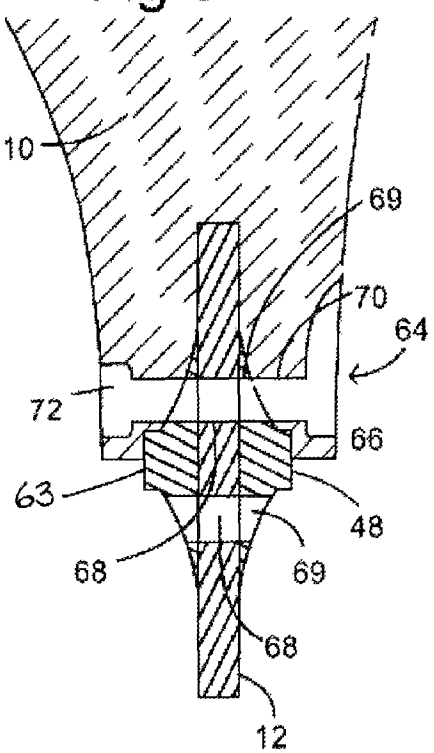

In addition to or instead of the interlocking means between the holder 10 and the blade supports 48, blade 12 may be provided with a locking mechanism 64 to secure it within holder 10. One exemplary locking mechanism 64 is best shown in FIGS. 9*a* and 9*b*. The passageways 68 in blade 12 are preferably located along the length of the blade 12 between the curved ends 40 (not shown) and either above and below or along the longitudinal centrelines of blade 12 and blade supports 48. When the blade supports 48 are properly connected about blade 12, each passageway 68 is aligned with and coaxial with corresponding passageways 69 in blade supports 48. When the blade assembly 56 is properly inserted within the holder 12, each set of passageways 68, 69 is aligned with and coaxial with a corresponding opening 70 in the holder 10, such that fasteners 66 may pass through and secure the blade 12, blade supports 48 and blade holder 10 together. Examples of fasteners 66 include cotter pins, retaining pins, dowels, spring pins, screws, thumbscrews and bolts, but any suitable removable fastening mechanism may be used. Supporting hardware such as nuts 72 and washers 74 may also be used as necessary, although it is preferable to minimize the number of loose parts that may be dislodged and misplaced. Preferably the fasteners are of a type that does not require tools to insert and remove, but such fasteners may be used if necessary.

Figure 10B:
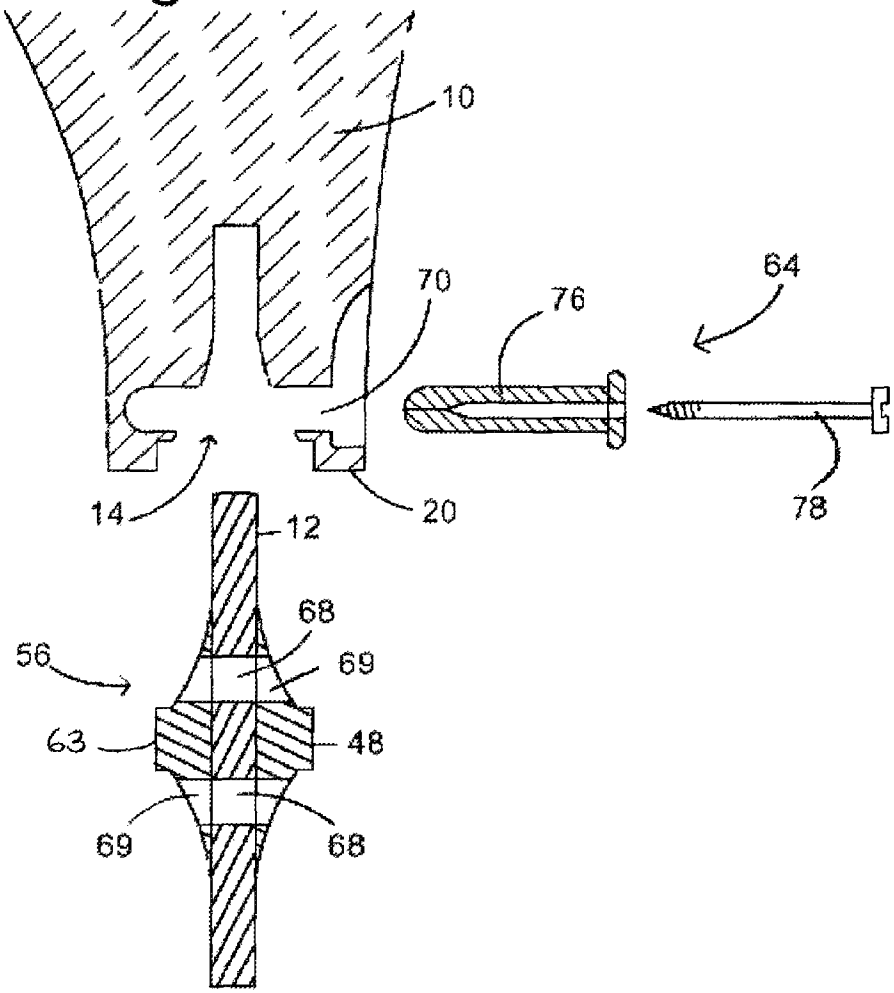
FIGS. 10*a* and 10*b* are sectional views of a second locking mechanism, taken along line A-A of FIG. 1.
Figure 10A:
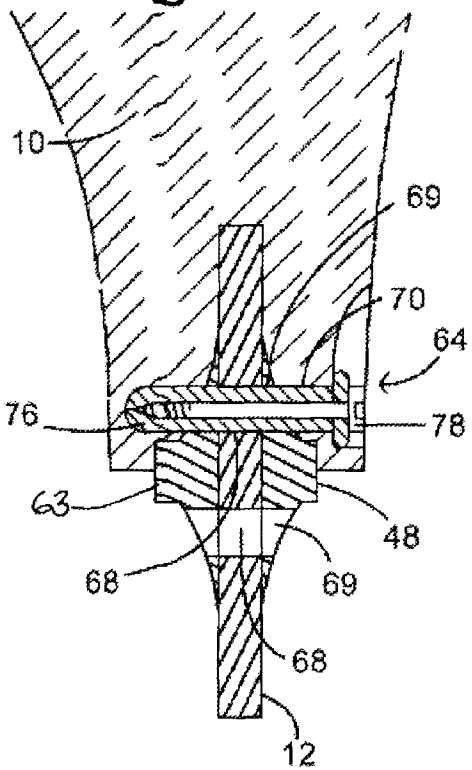

In another exemplary locking mechanism 64, shown in FIGS. 10*a* and 10*b*, passageways 68, 69, 70 accommodate a conical anchor 76 or similar expandable sleeve, into which a suitable fastener 78 is inserted. As fastener 78 is inserted into conical anchor 76, the tip of fastener 78 acts as a wedge, pushing the parts of conical anchor 76 away from each other and therefore into tighter contact with one or more of passageways 68, 69, 70. This acts to secure the locking mechanism into the passageways, and to securely but removably retain the blade assembly 56 within the holder 10.

Blade support 48 may also be provided with at least one impact distribution surface, shown in one embodiment in FIGS. 1-2*b* as a ridge 63 along or parallel to the longitudinal axis of the blade support. The interaction of ridge 63 with blade holder 10 is best seen in FIGS. 9*a* and 10*a*, where it can be seen that ridge 63 fits snugly within groove 14 in lower edge 20 of blade holder 10. Any downward force applied to the blade holder 10, such as by a skater jumping on or onto the ice, stepping, or taking strong strides, is distributed along the blade support 48. In the absence of an impact distribution surface, such forces would tend to concentrate about the fasteners, subjecting them to severe shear forces that could shorten the expected lifespan of the locking mechanism 64.

In use, the blade assembly 56 may be removed from the holder 10 as desired, for example when the exposed blade edge is too dull or is otherwise unsuitable for the ice conditions, or when one or both of the blade supports 48 has been broken. To do so, the user would merely have to release the locking mechanism 64 and pull the blade assembly 56 free from holder 10 The blade assembly 56 may then be disassembled, removing whichever pieces (any or all of blade 12 and blade supports 48) are to be replaced, or the entire assembly 56 may be replaced with another suitable assembly 56. Alternatively, blade assembly 56 may simply be flipped over, such that the opposite blade edge 38 is now exposed and will become the ice-contacting edge. The new or reassembled blade assembly 56 may then be inserted within holder 10 and locked into place. It is contemplated that one or both edges of blade 12 may then be sharpened when it is more convenient to do so. It is also contemplated that one or more pieces of the removed blade assembly 56 (i.e. the blade 12 and/or one or more blade supports 48) may be discarded.

It is contemplated that the blade 12, while being of substantially the configuration shown, can be made with variations in blade thickness, profile (radius and rocker) and hollow radius, to suit the needs of different sports, different ice conditions, different skater size, weight, strength and skill levels, and different playing roles. For example, softer ice will require a different blade hollow radius than harder ice. A speed skater will use a thinner blade than a hockey player. A heavier skater will require a different profile than a lighter skater. A hockey player playing in a forward position may prefer a different blade profile to allow for increased maneuverability than a player playing on defense, who may skate backward more frequently than forward.

Generally, both of the opposed edges 38 will have similar characteristics, such as being made of the same material, and shaped with the same hollow, profile and/or taper, such that the blade 12 comprises two opposed edges 38 that are truly interchangeable with each other. However, it is contemplated that a blade 12 may be provided with differing characteristics between the two opposed edges 38, such as being made of different materials, or having different hollow radii and/or different profiles, such that a skater can choose which blade edge will perform best in a particular situation or under specific ice conditions without having to carry around too many replacement blades 12.

Figure 11:
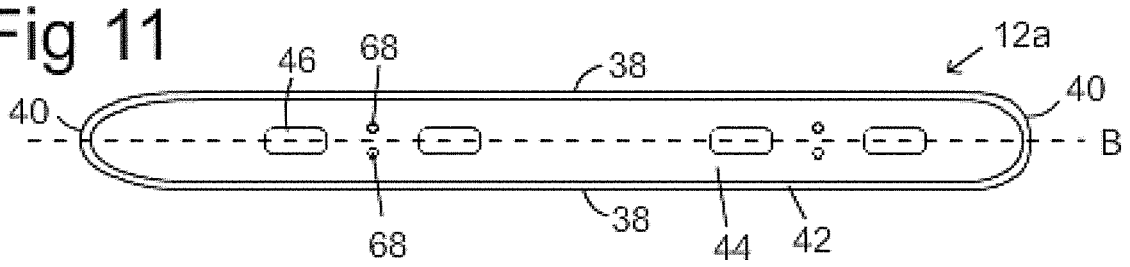
FIG. 11 is a side view of another embodiment of the double-edged skate blade.

It is also contemplated, as shown in FIG. 11, that blade 12*a* may be comprised of a plurality of parts, namely an outer section 42 which forms the ice-contacting surfaces of the blade 12, and an inner composite section 44, which may reduce the overall weight of the blade. In each case, any suitable material may be used; for example, the outer section 42 may be composed of stainless steel, carbon steel, aluminum, titanium, ceramic, combinations of these materials, or other suitable material capable of holding an edge, while the inner section 48 may be composed of any suitably strong and lightweight material, such as aluminum, carbon fibre, thermoplastic material, or a similar composite material.

In order to protect double-edged blades from damage, or from injuring the skater while not in use on a skate, a sleeve may be provided. The sleeve may also be used as a hand guard, to protect the skater's hand while removing or inserting a blade from the skate.

In the foregoing specification, the invention has been described with reference to specific embodiments thereof. However, it will be appreciated by those skilled in the art that other variations to the preferred embodiment described herein may be practised without departing from the scope of the invention, such scope being properly defined by the following claims. The scope of the claims should therefore not be limited by the preferred embodiments set forth in the examples, but should be given the broadest interpretation consistent with the description as a whole. The specification and drawings are, accordingly, to be regarded in an illustrative rather than a restrictive sense.

What is claimed is:

1. A removable double-edged blade assembly for an ice skate having a boot and a blade holder attached to said boot, said assembly comprising:

an elongated skate blade having a pair of opposed ice-contacting edges, and a plurality of apertures through said blade between said opposed ice-contacting edges;

a plurality of elongated blade supports, each having:

an inner surface;

an opposed outer surface; and at least one alignment means on said inner surface, adapted to align with at least one of said apertures and to removably mate said blade supports with said blade;

wherein said alignment means and said inner surface are inseparable; and wherein said outer surface is removably seatable within said blade holder, such that said blade holder covers a portion of said blade and a portion of each of said blade supports; and at least one set of coaxial passageways in said blade and said blade supports to accommodate a fastener to connect said blade and said blade supports to a corresponding coaxial passageway in said blade holder.

2. The blade assembly of claim 1, wherein said alignment means comprises one or more projections on said inner surface, each of said projections being adapted to mate with one of said apertures.

3. The blade assembly of claim 1 wherein said alignment means further comprises connecting means to connect said blade supports to each other.

4. The blade assembly of claim 3 wherein said connecting means comprises studs on one of said blade supports and corresponding cavities on another of said blade supports.

5. The blade assembly of claim 1, further comprising means to removably interlock said blade assembly to said blade holder.

6. The blade assembly of claim 5 wherein said means to interlock said skate blade comprises teeth on said outer surface of at least one of said blade supports to correspond to teeth on said blade holder.

7. The blade assembly of claim 1 further comprising at least one expandable sleeve insertable in said passageways to accommodate said fastener.

8. The blade assembly of claim 1 wherein said blade comprises one or more inset sections to accommodate said blade supports.

9. The blade assembly of claim 1 wherein at least one of said blade supports further comprises at least one impact distribution surface on said outer surface of said blade support, in contact with a lower edge of said blade holder, to absorb impact transmitted downwardly through said blade holder.

10. The blade assembly of claim 9 wherein said impact distribution surface comprises a ridge parallel to a longitudinal centreline of said blade support.

11. A skate blade holder for an ice skate comprising:

an upper platform to be attached to said ice skate;

opposed sidewalls depending from said upper platform and terminating in a lower edge;

a substantially planar groove between said opposed sidewalls at said lower edge to accommodate a removable double edged skate blade assembly comprising:

an elongated skate blade having a pair of opposed ice-contacting edges, and a plurality of elongated blade supports such that said blade supports separate said blade holder from said blade along said blade supports;

at least one set of coaxial passageways in said blade holder to accommodate a fastener to connect said blade and said blade supports to said blade holder; and at least one interlocking means within said groove adapted to interlock with a corresponding interlocking means on at least one of said blade supports, such that said blade holder covers a portion of said blade and a portion of each of said blade supports;

wherein said interlocking means comprises at least one set of teeth corresponding to a set of teeth on an outer surface of at least one of said blade supports.

12. The blade assembly of claim 11 further comprising at least one expandable sleeve insertable in said passageways to accommodate said fastener.

13. An ice skate with a double-edged skate blade assembly, comprising:

an elongated skate blade having a pair of opposed ice-contacting edges, and a plurality of apertures through said blade between said opposed ice-contacting edges;

a plurality of elongated blade supports, each having an inner surface bearing at least one alignment means adapted to align with at least one of said apertures and to removably mate said blade supports with said blade, said alignment means and said inner surface being inseparable, and an opposed outer surface;

a blade holder to removably secure said blade and blade supports to said ice skate by removably seating said outer surface within said blade holder, such that said blade holder covers a portion of said blade and a portion of each of said blade supports; and a set of coaxial passageways in said blade, said blade supports and said blade holder to accommodate a fastener to connect said blade and said blade supports to said blade holder.

14. The ice skate of claim 13 wherein said blade holder further comprises:

an upper platform to be attached to said ice skate;

opposed sidewalls depending from said upper platform and terminating in a lower edge;

a groove between said opposed sidewalls at said lower edge to accommodate said double edged skate blade assembly; and at least one interlocking means within said groove adapted to interlock with a corresponding interlocking means on said outer surface of at least one of said blade supports.

* * * * *